US006691654B2

(12) United States Patent
Uehara et al.

(10) Patent No.: US 6,691,654 B2
(45) Date of Patent: Feb. 17, 2004

(54) VALVE-LASH ADJUSTER EQUIPPED VALVE OPERATING DEVICE FOR INTERNAL COMBUSTION ENGINE

(75) Inventors: Hirokazu Uehara, Kanagawa (JP); Seiji Tsuruta, Kanagawa (JP)

(73) Assignee: Hitachi Unisia Automotive, Ltd., Atsugi (JP)

( * ) Notice: Subject to any disclaimer, the term of this patent is extended or adjusted under 35 U.S.C. 154(b) by 0 days.

(21) Appl. No.: 10/307,936

(22) Filed: Dec. 3, 2002

(65) Prior Publication Data

US 2003/0101952 A1 Jun. 5, 2003

(30) Foreign Application Priority Data

Dec. 4, 2001 (JP) ..... 2001-369758

(51) Int. Cl.[7] ..... F01L 1/34
(52) U.S. Cl. ..... 123/90.16; 123/90.39
(58) Field of Search ..... 123/90.15, 90.16, 123/90.17, 90.39, 90.4, 90.41, 90.42, 90.43, 90.44, 90.45, 90.46

(56) References Cited

U.S. PATENT DOCUMENTS 4,655,178 A * 4/1987 Meneely ..... 123/321
5,988,125 A 11/1999 Hara et al.
6,401,676 B1 * 6/2002 Tsukui ..... 123/90.16

FOREIGN PATENT DOCUMENTS

JP 2000-213313 8/2000

* cited by examiner

*Primary Examiner*—Thomas Denion
*Assistant Examiner*—Jaime Corrigan
(74) *Attorney, Agent, or Firm*—Foley & Lardner

(57) ABSTRACT

A valve-lash adjuster equipped valve operating device for an internal combustion engine includes a biasing device biasing an engine valve in a valve-closing direction, and a valve drive mechanism opening the engine valve against the spring bias of the biasing device. A hydraulic zero lash adjuster is disposed between the engine valve and the valve drive mechanism to provide zero valve lash. A restriction device is provided to restrict a compressive force applied from each of the engine valve and the valve drive mechanism to the zero lash adjuster, when the engine is stopped.

20 Claims, 10 Drawing Sheets

VALVE-LASH ADJUSTER EQUIPPED VALVE OPERATING DEVICE FOR INTERNAL COMBUSTION ENGINE

TECHNICAL FIELD

The present invention relates to a valve-lash adjuster equipped valve operating device for an internal combustion engine, and particularly to techniques for improving operating characteristics of a hydraulic zero-valve-lash adjuster employed in an engine valve operating device, capable of providing zero valve clearance (or zero valve lash) when restarting the engine.

BACKGROUND ART

One such zero valve-lash adjuster equipped valve operating device has been disclosed in Japanese Patent Provisional Publication No. 2000-213313 (hereinafter is referred to as JP2000-213313). In the valve operating device disclosed in JP2000-213313, a hydraulic zero lash adjuster is installed in an electromagnetically-operated valve. The valve operating unit of JP2000-213313 includes a flange-shaped or disk-shaped armature and an armature shaft, both constructing a flanged plunger, a pair of electromagnetic coils respectively facing to both faces of the flange-shaped armature, and a pair of coil springs permanently biasing an intake valve stem respectively in a direction opening the intake valve and in a direction closing the intake valve, the coil spring pair cooperating with the electromagnetic coil pair to electromagnetically open and close the intake valve by electromagnetic force (attraction force) plus spring bias. The hydraulic zero lash adjuster is disposed between the intake-valve stem end and the armature shaft end, to provide zero valve lash and to provide a cushioning effect that permits this arrangement without undue shock loading and thus to reduce noise during operation. The hydraulic lash adjuster is designed to axially slightly contract, while leaking working oil from a high-pressure chamber in a state where the intake valve is opening. On the contrary, when the intake valve becomes conditioned in its fully-closed state, the hydraulic lash adjuster axially expands by supplying working oil into the high-pressure chamber as the clearance between the intake-valve stem end and the armature shaft end increases. A compressive force (or a spring load) axially acts on the hydraulic zero lash adjuster by means of the lower spring, which biases the intake-valve stem in the valve-closing direction. Oil leak from the high-pressure chamber to the reservoir chamber is restricted by means of a check valve built in the zero lash adjuster, thus maintaining the axial length of the zero lash adjuster. Actually, there is a possibility of leakage of oil from the aperture defined between component parts of the zero lash adjuster. In the stopped state of the engine, the zero lash adjuster is axially spring-loaded between the armature shaft and the intake-valve stem end in the compressive direction. Due to the spring load, the working fluid in the high-pressure chamber is compressed, and whereby a portion of working fluid tends to leak from the high-pressure chamber. With the lapse of time, there is an increased tendency for the zero lash adjuster to remarkably contract owing to the spring load. When restarting the engine with such remarkable contraction of the zero lash adjuster, the zero lash adjuster tends to axially rapidly expand, and thus air is introduced into each of the reservoir chamber and the high-pressure chamber and undesirably blended with the working fluid in these chambers. This results in unstable opening and closing operations of the intake valve. In particular, when a working-fluid chamber of a zero lash adjuster has a relatively small volumetric capacity, the accuracy of opening and closing operations of the intake valve may be greatly affected by working fluid mixed with air.

SUMMARY OF THE INVENTION

Accordingly, it is an object of the invention to provide a valve-lash adjuster equipped valve operating device, which avoids the aforementioned disadvantages.

In order to accomplish the aforementioned and other objects of the present invention, a valve operating device for an internal combustion engine with an engine valve that opens and closes either of an intake port and an exhaust port of the engine, comprises a biasing device that biases the engine valve in a valve-closing direction, a valve drive mechanism that opens the engine valve against a biasing force of the biasing device, a hydraulic zero lash adjuster disposed between the engine valve and the valve drive mechanism to adjust each of a clearance between the hydraulic zero lash adjuster and the engine valve and a clearance between the hydraulic zero lash adjuster and the valve drive mechanism to a zero clearance, and a restriction device that restricts a compressive force applied from each of the engine valve and the valve drive mechanism to the hydraulic zero lash adjuster when the engine is stopped.

According to another aspect of the invention, a valve operating device for an internal combustion engine with an engine valve that opens and closes either of an intake port and an exhaust port of the engine, comprises a biasing device that biases the engine valve in a valve-closing direction, a valve drive mechanism that opens the engine valve against a biasing force of the biasing device, a hydraulic zero lash adjuster disposed between the engine valve and the valve drive mechanism to adjust each of a clearance between the hydraulic zero lash adjuster and the engine valve and a clearance between the hydraulic zero lash adjuster and the valve drive mechanism to a zero clearance, a restriction device that restricts a compressive force applied from each of the engine valve and the valve drive mechanism to the hydraulic zero lash adjuster when the engine is stopped, the valve drive mechanism comprising (a) a drive shaft rotating in synchronism with rotation of an engine crankshaft and having a drive cam integrally formed on an outer periphery of the drive shaft, (b) a rockable cam opening the engine valve against a biasing force produced by the biasing device via the hydraulic zero lash adjuster, (c) a rocker arm linked at one end to the drive cam and linked at the other end to the rockable cam, and (d) a control shaft having a control cam integrally formed on an outer periphery of the control shaft and oscillatingly supporting the rocker arm via the control cam, the valve lift of the engine valve being variably controlled by adjusting an angular position of the control shaft based on engine operating conditions and by changing a center of oscillating motion of the rocker arm, and the valve lift being set to the zero lift by controlling the angular position of the control shaft by means of the restriction device.

According to a further aspect of the invention, a valve operating device for an internal combustion engine with an engine valve that opens and closes either of an intake port and an exhaust port of the engine, comprises a biasing device that biases the engine valve in a valve-closing direction, a valve drive mechanism that opens the engine valve against a biasing force of the biasing device, a hydraulic zero lash adjuster disposed between the engine valve and the valve drive mechanism to adjust each of a clearance between the hydraulic zero lash adjuster and the engine valve and a clearance between the hydraulic zero lash adjuster and the valve drive mechanism to a zero clearance, a restriction device that restricts a compressive force applied from each of the engine valve and the valve drive mechanism to the hydraulic zero lash adjuster when the engine is stopped, the valve drive mechanism comprising (a) an armature mechanically linked to the engine valve (b) a valve-opening electromagnet creating an attraction force acting on the armature in a direction opening of the engine valve, (c) a valve-closing electromagnet creating an attraction force acting on the armature in a direction closing of the engine valve, and (d) a biasing device creating a biasing force that holds the engine valve toward a neutral position by biasing the engine valve in the direction opening of the engine valve and in the direction closing of the engine valve, the hydraulic zero lash adjuster being disposed between the engine valve and the armature, and the restriction device comprising a restriction member that restricts movement of the armature toward the hydraulic zero lash adjuster and movement of the engine valve toward the hydraulic zero lash adjuster when the engine is stopped.

According to a still further aspect of the invention, a valve operating device for an internal combustion engine with an engine valve that opens and closes either of an intake port and an exhaust port of the engine, comprises a biasing means for biasing the engine valve in a valve-closing direction, a valve drive means for opening the engine valve against a biasing force of the biasing means, a valve-lash adjusting means disposed between the engine valve and the valve drive means for adjusting each of a clearance between the valve-lash adjusting means and the engine valve and a clearance between the valve-lash adjusting means and the valve drive means to a zero clearance, and a restriction means for restricting a compressive force applied from each of the engine valve and the valve drive means to the valve-lash adjusting means when the engine is stopped.

According to another aspect of the invention, a valve operating device for an internal combustion engine with an engine valve that opens and closes either of an intake port and an exhaust port of the engine, comprises a biasing device that biases the engine valve in a valve-closing direction, a valve drive mechanism that opens the engine valve against a biasing force of the biasing device, a hydraulic zero lash adjuster disposed between the engine valve and the valve drive mechanism to adjust each of a clearance between the hydraulic zero lash adjuster and the engine valve and a clearance between the hydraulic zero lash adjuster and the valve drive mechanism to a zero clearance, a restriction device that restricts a compressive force applied from each of the engine valve and the valve drive mechanism to the hydraulic zero lash adjuster when the engine is stopped, a cam that changes rotary motion of the cam to reciprocating motion of the engine valve, and the restriction device returning the valve lift to the zero lift so that there is no application of the compressive force from each of the engine valve and the valve drive mechanism to the hydraulic zero lash adjuster when the engine is stopped.

According to another aspect of the invention, a valve operating device for an internal combustion engine with an engine valve that opens and closes either of an intake port and an exhaust port of the engine, comprises a biasing device that biases the engine valve in a valve-closing direction, a valve drive mechanism that opens the engine valve against a biasing force of the biasing device, a hydraulic zero lash adjuster disposed between a stem end of the engine valve and the valve drive mechanism to adjust each of a clearance between the hydraulic zero lash adjuster and the engine valve and a clearance between the hydraulic zero lash adjuster and the valve drive mechanism to a zero clearance, a restriction device that restricts a compressive force applied from each of the engine valve and the valve drive mechanism to the hydraulic zero lash adjuster when the engine is stopped, the valve drive mechanism comprising (a) an armature mechanically linked to the engine valve, (b) a valve-opening electromagnet creating an attraction force acting on the armature in a direction opening of the engine valve, (c) a valve-closing electromagnet creating an attraction force acting on the armature in a direction closing of the engine valve, (d) a biasing device creating a biasing force that holds the engine valve toward a neutral position by biasing the engine valve in the direction opening of the engine valve and in the direction closing of the engine valve, and (e) an armature shaft to which the hydraulic zero lash adjuster is linked; the armature shaft being concentric to a stem of the engine valve, and the restriction device comprising a restriction member that locks the armature shaft so that there is no application of the compressive force from each of the engine valve and the valve drive mechanism to the hydraulic zero lash adjuster when the engine is stopped.

The other objects and features of this invention will become understood from the following description with reference to the accompanying drawings.

DESCRIPTION OF THE PREFERRED EMBODIMENTS

Figure 1:
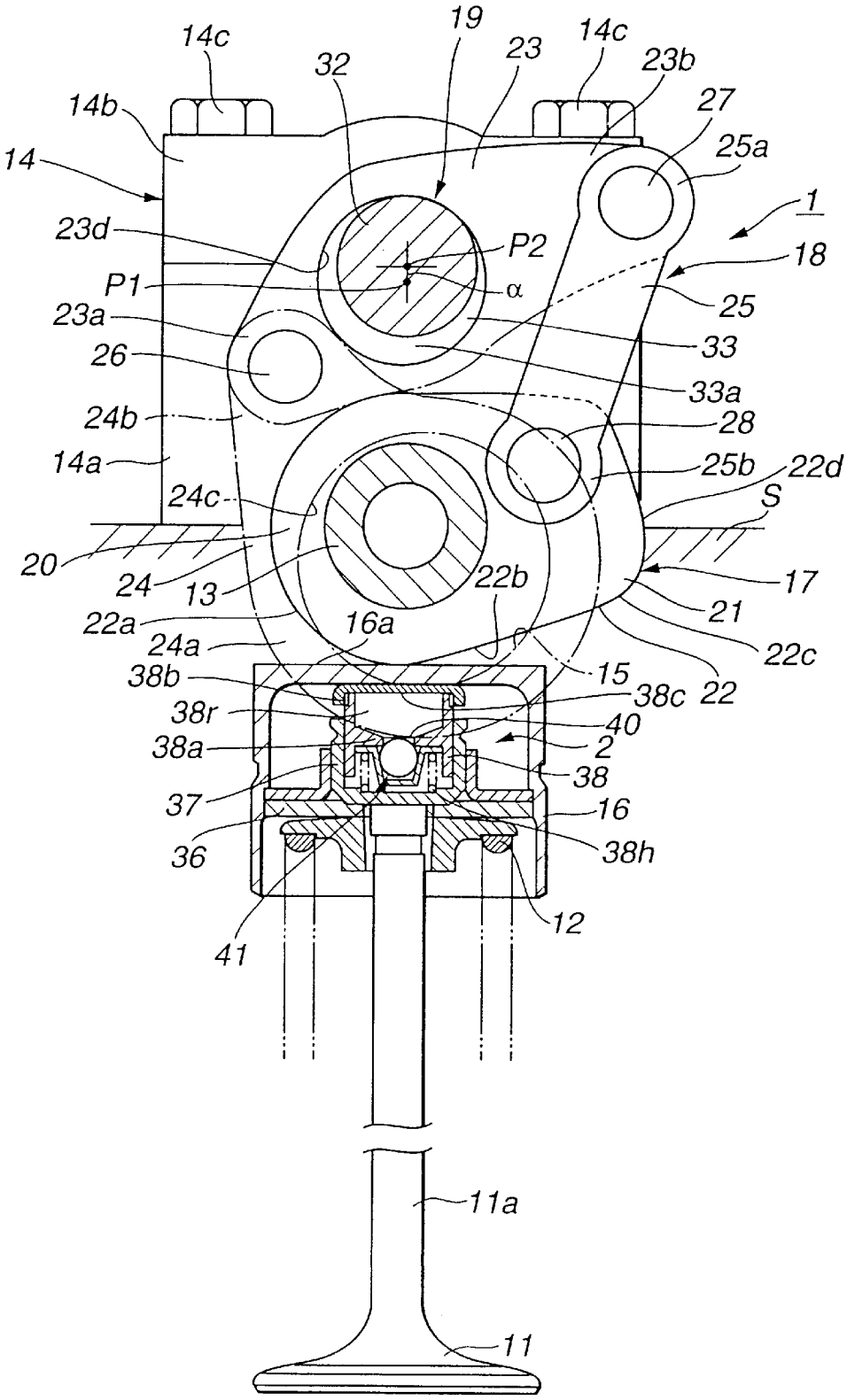
FIG. 1 is a partial cross-sectional view of a zero lash adjuster equipped valve operating device of the first embodiment, taken in the direction indicated by the arrow A of FIG. 2.
Figure 2:
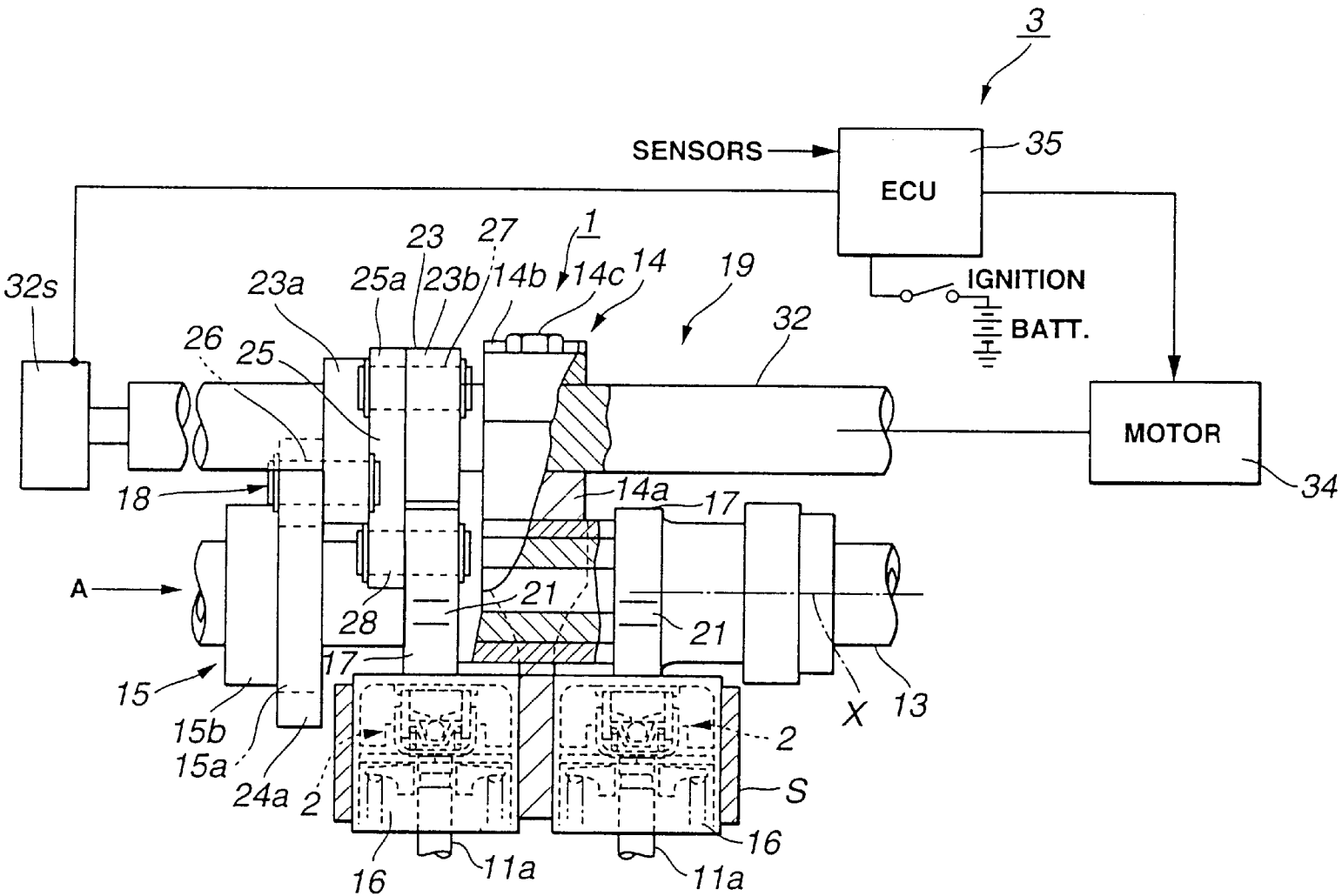
FIG. 2 is a partial cross-sectional view illustrating the essential part of the lash adjuster equipped valve operating device of the first embodiment.

Referring now to the drawings, particularly to FIGS. 1 and 2, the zero lash adjuster equipped variable valve operating device of the first embodiment is applied to an intake-port valve of engine valves of an internal combustion engine. As best seen in FIG. 2, the valve operating device of the embodiment employs two intake valves 11, 11 per one cylinder. The valve operating device includes a variable valve lift characteristic mechanism (a variable lift and working angle control mechanism) that enables the valve-lift characteristic (both a valve lift and a working angle of intake valve 11) to be continuously simultaneously varied depending on engine operating conditions. The valve operating device also includes a hydraulic zero lash adjuster (a valve-lash adjusting means) 2 disposed between the stem end of a valve stem 11*a* of intake valve 11 and a rockable cam 17 (described later) of variable valve lift characteristic mechanism 1, so as to provide zero valve lash. Also provided is a restriction mechanism or a restriction device (restriction means) 3 that sets the valve lift of intake valve 11 to a zero lift via rockable cam 17 just after shifting to an engine stopped state. Each intake valve 11 is slidably mounted on a cylinder head S by way of a valve guide (not shown). Intake valves 11, 11 are biased in their closed directions by respective valve springs 12, 12 (each serving as a biasing means or a biasing device). The upper end of valve stem 11*a* is kept in contact with hydraulic zero lash adjuster 2.

Variable valve lift characteristic mechanism 1 incorporated in the zero lash adjuster equipped valve operating device of the embodiment is similar to a variable valve actuation apparatus such as disclosed in U.S. Pat. No. 5,988,125, issued Nov. 23, 1999 to Hara et al, the teachings of which are hereby incorporated by reference. The construction of variable valve lift characteristic mechanism 1 is briefly described hereunder. Variable valve lift characteristic mechanism 1 is comprised of a cylindrical hollow drive shaft 13, a drive cam 15, rockable cams 17, 17, a motion transmitter (motion transmitting linkage means) 18, and a linkage control mechanism (linkage control means) 19. Drive shaft 13 is rotatably supported on a bearing 14 mounted on the upper portion of cylinder head S. Drive cam 15 is fixedly connected to the outer periphery of drive shaft 13 by way of press-fitting. Each rockable cam 17 is oscillatingly supported on drive shaft 13 to open or lift up the associated intake valve 11 by way of oscillating motion of rockable cam 17 in sliding-contact with the associated valve lifter 16 installed on the upper end of the valve stem end. Motion transmitter (motion transmitting linkage means) 18 transmits a rotary motion of drive cam 15 as an oscillating motion of rockable cam 17. Linkage control mechanism (linkage control means) 19 variably controls an initial actuated position of motion transmitter 18. Drive shaft 13 is laid out in the longitudinal direction of the engine. Rotary motion of an engine crankshaft is transferred into drive shaft 13 via a driven sprocket (not shown) attached to one end of drive shaft 13 and a timing belt or a timing chain (not shown) wound on the driven sprocket, so that drive shaft 13 rotates about its axis in synchronism with rotation of the crankshaft. Bearing 14 is comprised of a main bearing bracket 14*a* and a sub bearing bracket (a main bearing cap) 14*b*. The lower half-round section of main bearing bracket 14*a* cooperates with the half-round section of cylinder head S to rotatably support upper and lower halves of drive shaft 13. On the other hand, the upper half-round section of main bearing bracket 14*a* and the lower half-round section of main bearing cap 14*b* cooperates with each other to rotatably support a control shaft 32 (described later). Main bearing bracket 14*a* and main bearing cap 14*b* are both bolted onto the upper portion of cylinder head S by means of a pair of bolts 14*c* and 14*c*. Drive cam 15 is substantially ring-shaped, and comprised of an annular drive cambody 15*a* and a cylindrical portion 15*b* integrally formed with the outside end of annular drive cam body 15*a*. Drive cam 15 is formed as an eccentric cam whose axis is offset from the axis X of drive shaft 13 by a predetermined eccentricity. As viewed in the axial direction of drive shaft 13, rockable cam 17 has a raindrop shape. A base circle portion 20 of rockable cam 17 is rotatably fitted on the outer periphery of drive shaft 13 in such a manner as to directly push intake-valve lifter 16, which has a cylindrical bore closed at its upper end. Base circle portion 20 is concentric to drive shaft 13. Within base circle portion 20, a valve lift is zero. One end portion (a cam nose portion 21) of rockable cam 17 is formed therein with a connecting-pin hole for a connecting pin 28 (described later). Rockable cam 17 is formed with a cam contour surface portion 22. Cam contour surface portion 22 has a base circle surface 22*a*, a ramp surface 22*b* being continuous with base circle surface 22*a* and extending toward the cam nose portion 21, and a lift surface 22*c* being continuous with ramp surface 22*b* and extending toward a top surface 22*d* (a maximum lift surface) of the cam nose portion 21. The base circle portion 20 and cam contour surface portion 22, having base circle surface 22*a*, ramp surface 22*b*, lift surface 22*c*, and top surface 22*d* are designed to be brought into abutted-contact (sliding-contact) with a designated point or a designated position of the upper surface 16*a* of the associated intake-valve lifter 16, depending on an angular position of rockable cam 17 oscillating. Motion transmitter 18 includes a rocker arm 23, a link arm 24, and a link rod 25. Rocker arm 23 is located above drive shaft 13. Link arm 24 mechanically links one end 23*a* of rocker arm 23 to drive cam 15. Link rod 25 serves a link member that mechanically links the other end 23*b* of rocker arm 23 to rockable cam 17. Rocker arm 23 is rockably supported on the outer periphery of a control cam 33 of a control shaft 32 (described later). The one end 23*a* of rocker arm 23 is rotatably linked or pin-connected to link arm 24 by means of a connecting pin 26, whereas the other end 23*b* is rotatably linked or pin-connected to one end 25*a* of link rod 25 by means of a connecting pin 27. Link arm 24 has a substantially annular large-diameter portion 24*a*, and a protruded portion 24*b* radially outwardly protruding from a predetermined angular position of annular large-diameter portion 24*a*. Link arm 24 is formed therein with a central fitting bore 24*c*. Annular large-diameter portion 24*a* of link arm 24 is rotatably supported on drive cam body 15*a* of drive cam 15 by fitting the cylindrical outer peripheral surface of drive cam body 15*a* into central fitting bore 24*c*. Protruded portion 24*b* of link arm 24 is rotatably linked to the one end 23*a* of rocker arm 23 by means of connecting pin 26. As discussed above, link rod 25 is rotatably linked at the one end 25*a* to the other end 23*b* of rocker arm 23 via connecting pin 27, and also rotatably linked at the other end 25*b* to the cam nose portion 21 of rockable cam 17 via connecting pin 28. The central axis of connecting pin 28 serves as a pivot of rockable cam 17. Snap rings (not shown) are fitted to pin ends of connecting pins 26, 27, and 28, to restrict axial movements of link arm 24 and link rod 25.

As shown in FIGS. 1 and 2, linkage control mechanism 19 is comprised of the control shaft 32, control cam 33, an electric motor (an electrically-operated actuator) 34, and an electronic control unit (ECU) 35. Control shaft 32 is rotatably supported by the same bearing unit 14 as drive shaft 13 and located above and parallel to drive shaft 13. Control cam 33 is fixedly connected to or integrally formed with the outer periphery of control shaft 32, such that control cam 33 is slidably fitted into a supporting bore 23*d* of rocker arm 23. The axis of control cam 33 serves as a center of oscillating motion of rocker arm 23. Electric motor 34 drives control shaft 32 within a predetermined angular range from an angle corresponding to a minimum valve lift (a zero lift) to an angle corresponding to a maximum valve lift. Motor 34 is electronically controlled in response to a control signal from ECU 35. Control cam 33 is cylindrical in shape. As best seen in FIG. 1, control cam 33 has a relatively thick-walled, eccentric portion 33*a* and the axis P1 of control cam 33 is eccentric to the axis P2 of control shaft 32 by an eccentricity a. Therefore, the center of oscillating motion of rocker arm 23 can be varied by changing the angular position of control shaft 32. With the linkage structure discussed above, rotary motion of drive shaft 13 is converted into oscillating motion of rockable cam 17. In the shown embodiment, a direct-current pulse motor is used as electric motor 34. ECU 35 generally comprises a microcomputer. ECU 35 includes an input/output interface (I/O), memories (RAM, ROM), and a microprocessor or a central processing unit (CPU). The input/output interface (I/O) of ECU 35 receives input information from various engine/vehicle sensors, namely a crank angle sensor, an airflow meter, an engine temperature sensor (an engine coolant temperature sensor), and a control-shaft position sensor 32*s*. Within ECU 35, the central processing unit (CPU) allows the access by the I/O interface of input informational data signals from the previously-discussed engine/vehicle sensors to estimate engine operating conditions based on the sensor signals. The CPU of ECU 35 is responsible for carrying the engine control program (containing the variable valve lift characteristic control) stored in memories and is capable of performing necessary arithmetic and logic operations. Computational results (arithmetic calculation results), that is, a calculated output signal (a drive current or a control current) is relayed via the output interface circuitry of ECU 35 to an output stage, namely electric motor (pulse motor) 34.

As best seen in FIG. 1, hydraulic zero lash adjuster 2 is installed in each of valve lifters 16, 16. Hydraulic zero lash adjuster 2 is comprised of an annular supporting portion 36 fixedly connected to a substantially middle of valve lifter 16 in the axial direction, a substantially cylindrical body 37 fixedly connected to the central portion of annular supporting portion 36 and having a cylindrical bore closed at its lower end, and a plunger 38 provided inside of cylindrical body 37 such that the outer peripheral wall of plunger 38 is axially slidably fitted into the inner peripheral wall of cylindrical body 37. Annular supporting portion 36, cylindrical body 37, and plunger 38 are concentrically arranged with respect to the axis of valve lifter 16 (or the axis of intake-valve stem 11*a*). Plunger 38 has a partition wall portion 38*a* integrally formed therein. Partition wall portion 38*a* has a central communication hole 40. A high-pressure chamber 38*h* is defined between one side wall (the lower side wall in FIG. 1) of partition wall portion 38*a* and cylindrical body 37. A reservoir chamber 38*r* is defined in plunger 38 and above the other side wall (the upper side wall in FIG. 1) of partition wall portion 38*a* of plunger 38. Reservoir chamber 38*r* is communicated with high-pressure chamber 38*h* via central communication hole 40. A check valve 41 is disposed in high-pressure chamber 38*h* to permit only the working-fluid flow from reservoir chamber 38*r* to high-pressure chamber 38*h*. As shown in FIG. 1, a working-fluid supply hole 38*b* is bored in the upper peripheral wall of plunger 38 for hydraulic pressure supply (working-fluid pressure) to reservoir chamber 38*r*. The stem end of intake-valve stem 11*a* is inserted into the central hole of annular supporting portion 36 so that the intake-valve stem end is in contact with the closed end of cylindrical body 37. A cap 38*c* is attached to the upper opening end portion of plunger 38, so that the upper opening end portion of plunger 38 is hermetically closed by cap 38*c* in a fluid-tight fashion, and that the upper surface of cap 38*c* is conditioned in contact with the inner wall surface of the upper closed end of valve lifter 16.

In the hydraulic zero lash adjuster equipped valve operating device of the first embodiment shown in FIGS. 1 and 2, restriction device (restriction means) 3 is constructed by ECU 35, electric motor 34, and a car battery (see FIG. 1). The processor (control circuit) of ECU 35 determines or detects the engine stopped state by the turned-off state of an ignition key. ECU 35 operates to supply electric power to motor (electrically-operated actuator) 34 for a predetermined time period from a time when the engine stopped state has been detected, utilizing a delay timer, and whereby the valve lifts of all of intake valves 11 are reset to zero lifts by means of the respective rockable cams 17 by rotating control shaft 32 for the predetermined time period. During engine starting or restarting, motor (electrically-operated actuator) 34 is driven in such a manner as to increase the valve lift to ensure or optimize a cushioning effect of the hydraulic zero lash adjuster. Motor (electrically-operated actuator) 34 begins to shift from its inoperative state to its operative state when turning the ignition switch ON. After the engine has been started or restarted, motor (electrically-operated actuator) 34 is operated in accordance with a normal control mode based on engine operating conditions such as engine speed and engine load. Alternatively, the valve drive mechanism (variable valve lift characteristic mechanism 1) may be constructed so that the valve lift is adjusted to a zero lift by means of a preloading device (preloading means) such as a return spring. In this case, the preloading device acts to normally bias or preload control shaft 32 in the rotation direction that the valve lift is adjusted to the zero lift via rockable cam 17. As discussed above, control shaft 32 maybe preloaded so that the zero lift is achieved. As a matter of course, when increasing the valve lift from the zero lift, the valve drive mechanism must be operated against the preload. The valve operating device of the first embodiment operates as follows.

Figure 3A:
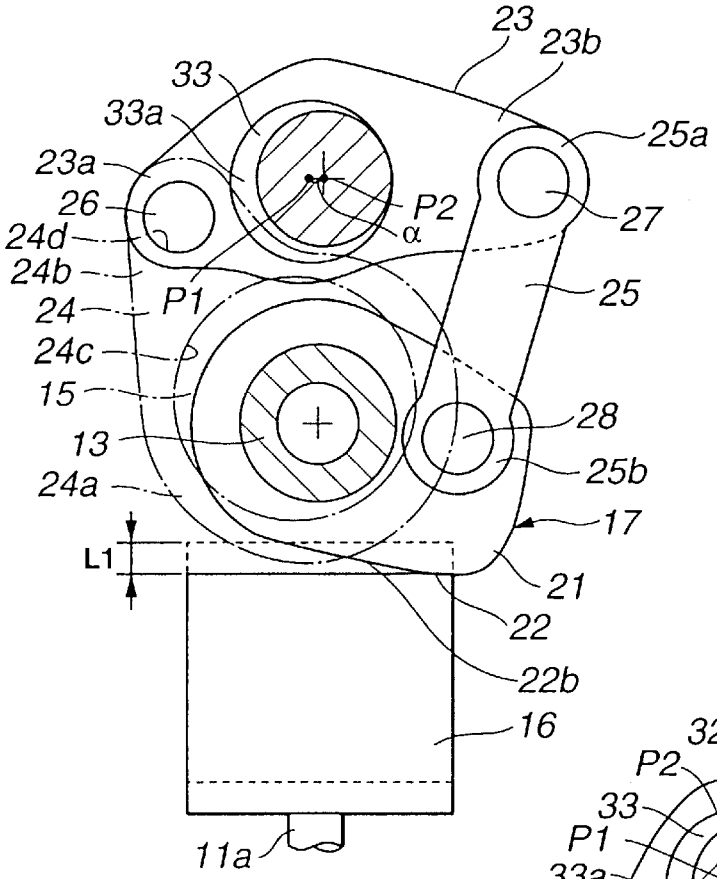
FIG. 3A is an explanatory view illustrating an open state of the intake valve during a minimum valve lift control mode.
Figure 3B:
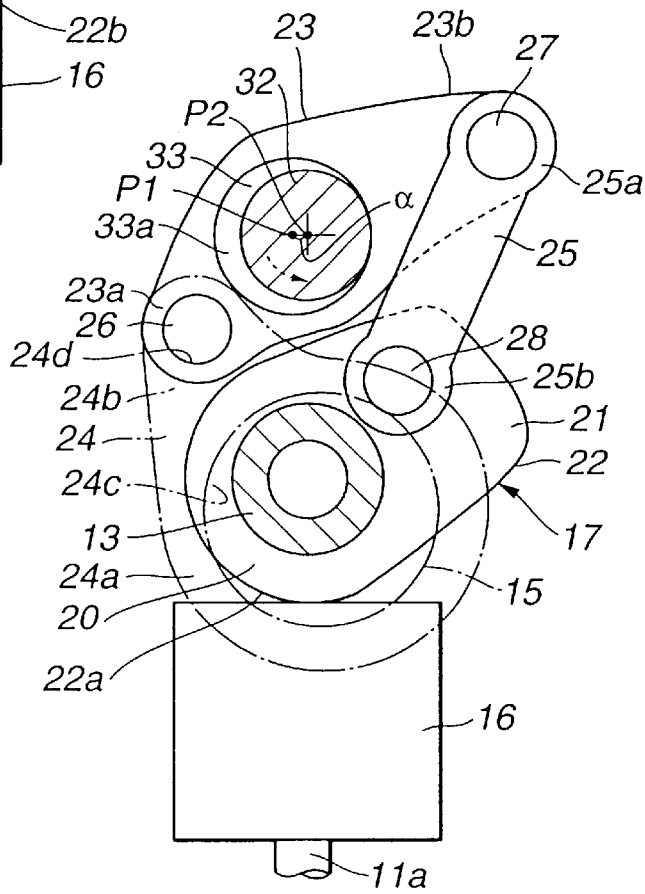
FIG. 3B is an explanatory view illustrating a closed state of the intake valve during the minimum valve lift control mode.
Figure 5:
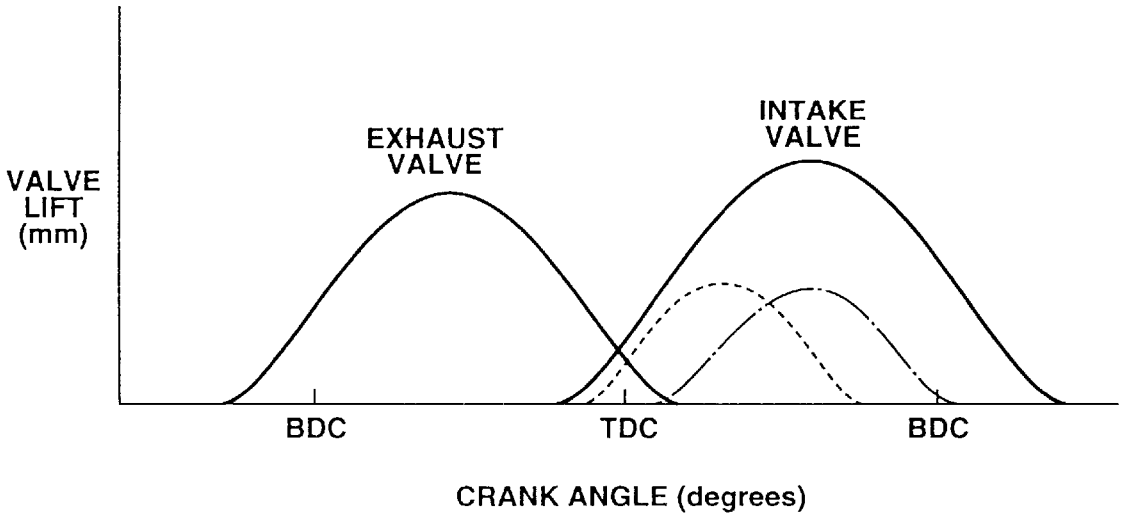
FIG. 5 shows valve lift characteristics of the valve operating device of the first embodiment.

During low-speed low-load operation, when motor 34 rotates in one rotation direction (clockwise direction as viewed from the drive-shaft axial direction of FIG. 1) in response to a control signal from ECU 35, the axis P1 of control cam 33 moves from a position shown in FIG. 1 to a position shown in FIGS. 3A and 3B. As a result of this, thick-walled eccentric portion 33*a* of control cam 33 is kept in the left-hand side with respect to the axis P2 of control shaft 32. Therefore, the pivot of the other end 23*b* of rocker arm 23 and the one end 25*a* of link rod 25 moves upwardly leftwards with respect to the axis of drive shaft 13. As a consequence, the cam nose portion 21 of rockable cam 17 is forcibly somewhat pulled up via link rod 25 such that rockable cam 17 rotates in the counterclockwise direction (see FIG. 3B). When drive cam 15 rotates with control cam 33 held at the angular position shown in FIGS. 3A and 3B, rotary motion of drive cam 15 is converted into oscillating motion of link arm 24. If link arm 24 pushes up the one end 23*a* of rocker arm 23, a lift corresponding to the pushing-up motion is transmitted from link rod 25 via rockable cam 17 to valve lifter 16. When control cam 33 is held in the angular position shown in FIGS. 3A and 3B, the valve lift L1 is set to a minimum valve lift. As set forth above, at the low-speed low-load operation, variable valve lift characteristic mechanism 1 operates at the minimum valve lift control mode at which the system (the device of the first embodiment) provides a minimum intake-valve-lift and working angle characteristic indicated by the one-dotted line of FIG. 5. As can be appreciated from the minimum intake-valve-lift and working angle characteristic curve of FIG. 5, an intake valve open timing IVO of intake valve 11 tends to retard while an exhaust valve open timing EVO and an exhaust valve closure timing EVC both are fixed (see the left-hand side exhaust valve lift characteristic curve indicated by the solid line in FIG. 5). Thus, during the low-speed low-load operation, a valve overlap, during which intake and exhaust valves are open together, becomes small. For the reasons discussed above, the device ensures improved fuel economy and stable combustion during low-speed low-load condition.

Figure 4A:
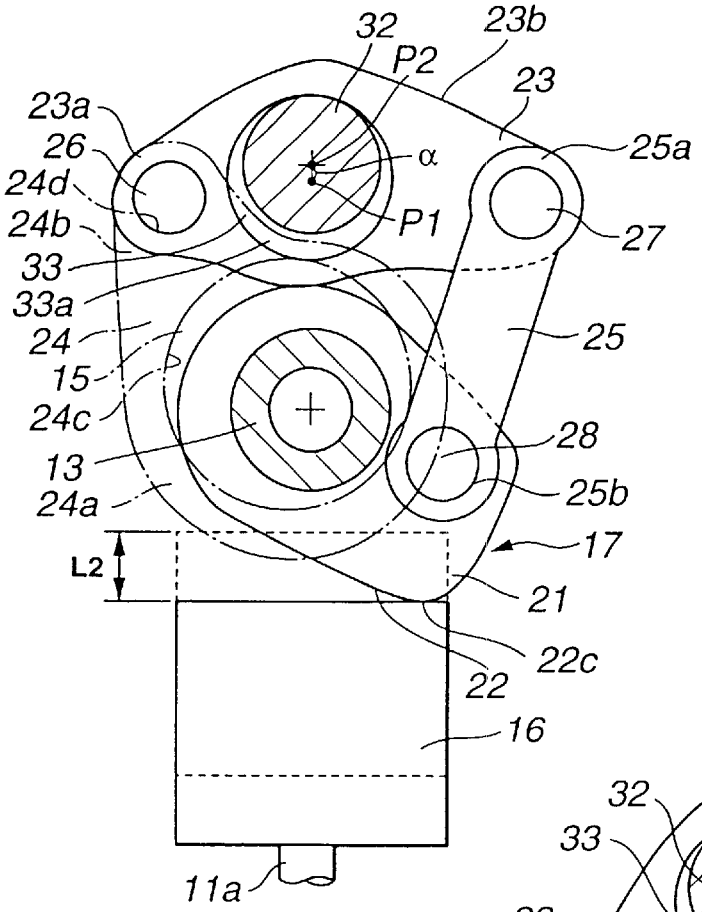
FIG. 4A is an explanatory view illustrating an open state of the intake valve during a maximum valve lift control mode.
Figure 4B:
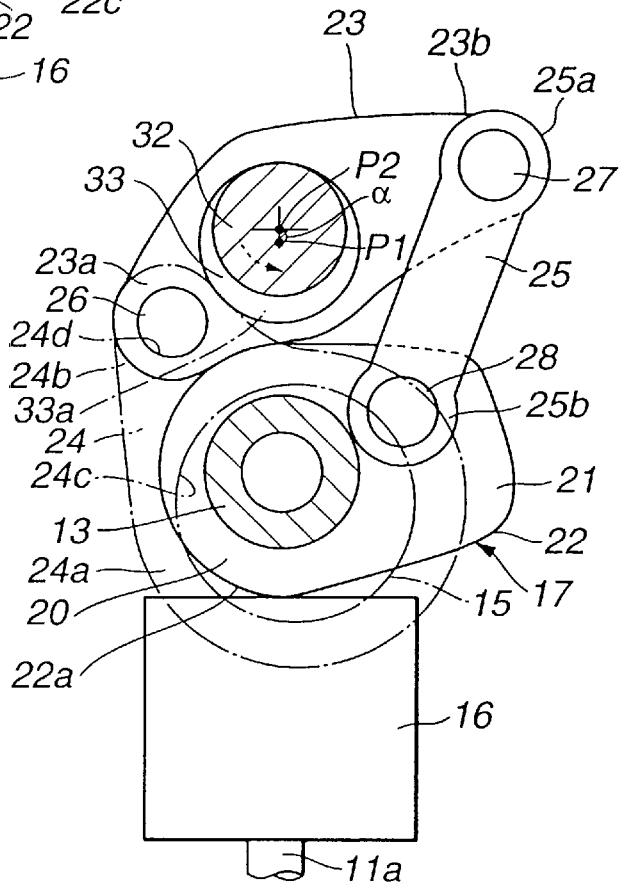
FIG. 4B is an explanatory view illustrating a closed state of the intake valve during the maximum valve lift control mode.

In contrast to the above, when the engine/vehicle operating condition has been shifted from the low-speed low-load condition to the high-speed high-load condition, motor 34 rotates in the opposite rotation direction (counterclockwise direction as viewed from the drive-shaft axial direction of FIG. 1) in response to a control signal from ECU 35. Thus, the axis P1 of control cam 33 moves from the position shown in FIGS. 3A and 3B to a position shown in FIGS. 4A and 4B. As a result of this, thick-walled eccentric portion 33*a* of control cam 33 is kept in the lower side with respect to the axis P2 of control shaft 32. Therefore, the rocker arm itself moves downwards with respect to the axis of drive shaft 13. As a consequence, the other end 23*b* of rocker arm 23 pushes down the cam nose portion 21 of rockable cam 17 via link rod 25 such that rockable cam 17 rotates in the clockwise direction (see FIG. 4B) by a predetermined angular phase. As can be appreciated from comparison between the abutted-contact positions of FIGS. 3A and 4A (or between the abutted-contact positions of FIGS. 3B and 4B), during the high-speed high-load operation (see FIGS. 4A and 4B) the abutted-contact position of rockable cam 17 with the upper surface of valve lifter 16 shifts slightly rightwards. For this reason, when the one end 23*a* of rocker arm 23 is pushed up via link arm 24 by rotary motion of drive cam 15 during the intake-valve opening period shown in FIG. 4A, the valve lift L2 is set to a maximum valve lift. As set forth above, at the high-speed high-load operation, variable valve lift characteristic mechanism 1 operates at the maximum valve lift control mode at which the system (the device of the first embodiment) provides a maximum intake-valve-lift and working angle characteristic indicated by the solid line of FIG. 5. As can be appreciated from the maximum intake-valve-lift and working angle characteristic curve of FIG. 5, intake valve open timing IVO tends to advance whereas intake valve closure timing IVC tends to retard. Thus, during the high-speed high-load operation, a charging efficiency of intake air can be enhanced, thereby ensuring adequate engine power.

During operation of the engine, working fluid is fed into reservoir chamber 38*r* of hydraulic zero lash adjuster 2 via working-fluid supply hole 38*b*. When plunger 38 extends in a direction that plunger 38 projects axially outwards from cylindrical body 37 during operation, working fluid is supplied via central communication hole 40 into high-pressure chamber 38*h* and thus plunger 38 is kept extended by virtue of the working-fluid pressure supplied into high-pressure chamber 38*h*. Therefore, the clearance defined between intake valve 11 (exactly, the stem end of intake-valve stem 11*a*) and rockable cam 17 can be absorbed or eliminated by proper extension of plunger 38 so as to provide zero valve lash. The performance of application-force transmission or motion transmission from rockable cam 17 to each intake valve 11 can be enhanced. By means of the use of hydraulic zero lash adjuster 2, it is possible to prevent or reduce noise during operation of the engine, in particular, during the engine starting period.

On the contrary, when the operating condition of the engine becomes shifted to its stopped state, ECU 35 included in restriction device (restriction means) 3 temporarily generates a control current to electric motor 34 in a manner so as to rotate control cam 33 fixedly connected to control shaft 32 in a predetermined or preprogrammed rotation direction, and to pull up the cam nose portion 21 of rockable cam 17 via rocker arm 23 so that base circle portion 20 having base circle surface 22*a* is brought into sliding-contact with the upper surface of valve lifter 16 and as a result each intake valve 11 is maintained at the zero-lift position (the valve fully-closed position). That is, the restriction device functions as a zero-lift position return means that returns the valve lift to the zero lift when the engine is stopped. With each intake valve 11 maintained at the zero-lift position in the engine stopped state, pressure (a compressive force) is not applied through rockable cam 17 and valve lifter 16 to plunger 38 of hydraulic zero lash adjuster 2. As a result, the device of the first embodiment can reliably avoid hydraulic zero lash adjuster 2 from being sandwiched between the associated intake valve 11 and rockable cam 17 under pressure, in the engine stopped state. This prevents undesired leakage of working fluid from high-pressure chamber 38*h* or reservoir chamber 38*r*. Under these conditions, when the engine is restarted, there is no rapid expansion of plunger 38 of hydraulic zero lash adjuster 2 in the axial direction, thereby preventing hammering noise (or tappet noise) from occurring between each rockable cam 17 and valve lifter 16, and preventing air from being introduced into reservoir chamber 38*r* or high-pressure chamber 38*h* and undesirably blended with working fluid in these chambers 38*r* and 38*h*. This enhances stability and reliability of opening and closing operations of each intake valve 11. As discussed above, according to the device of the first embodiment, just after the engine is stopped, electric motor 34 is temporarily driven by ECU 35 to maintain or stand by each intake valve 11 at the zero-lift position. Thus, the amount of electric power consumption of the car battery can be reduced to a minimum. The hydraulic zero lash adjuster equipped valve operating device of the first embodiment is exemplified in an intake valve operating device with variable valve lift characteristic mechanism 1 having a plurality of links (containing at least rockable cam 17, rocker arm 23, link arm 24, link rod 25). In this case, there is an increased tendency for noises to be created from linked portions of the plurality of links. The hydraulic zero lash adjuster employed in the device of the first embodiment can provide a better cushioning effect (a better noise-reduction effect) even in case of the use of variable valve lift characteristic mechanism 1 having multiple links. The hydraulic zero lash adjuster equipped valve operating device of the first embodiment is exemplified in the reciprocating engine having the variable valve lift characteristic mechanism 1 that enables the valve-lift characteristic (both the valve lift and working angle of intake valve 11) to be continuously simultaneously varied depending on engine operating conditions. It will be appreciated that the fundamental concept of the invention may be applied to a reciprocating engine having both a variable phase control mechanism (see the characteristic curve indicated by the broken line, phase-advanced from the characteristic curve indicated by the one-dotted line in FIG. 5) that variably changes the phase of intake valve 11, and variable valve lift characteristic mechanism 1 that enables the valve-lift characteristic (both the valve lift and working angle of intake valve 11).

Figure 6:
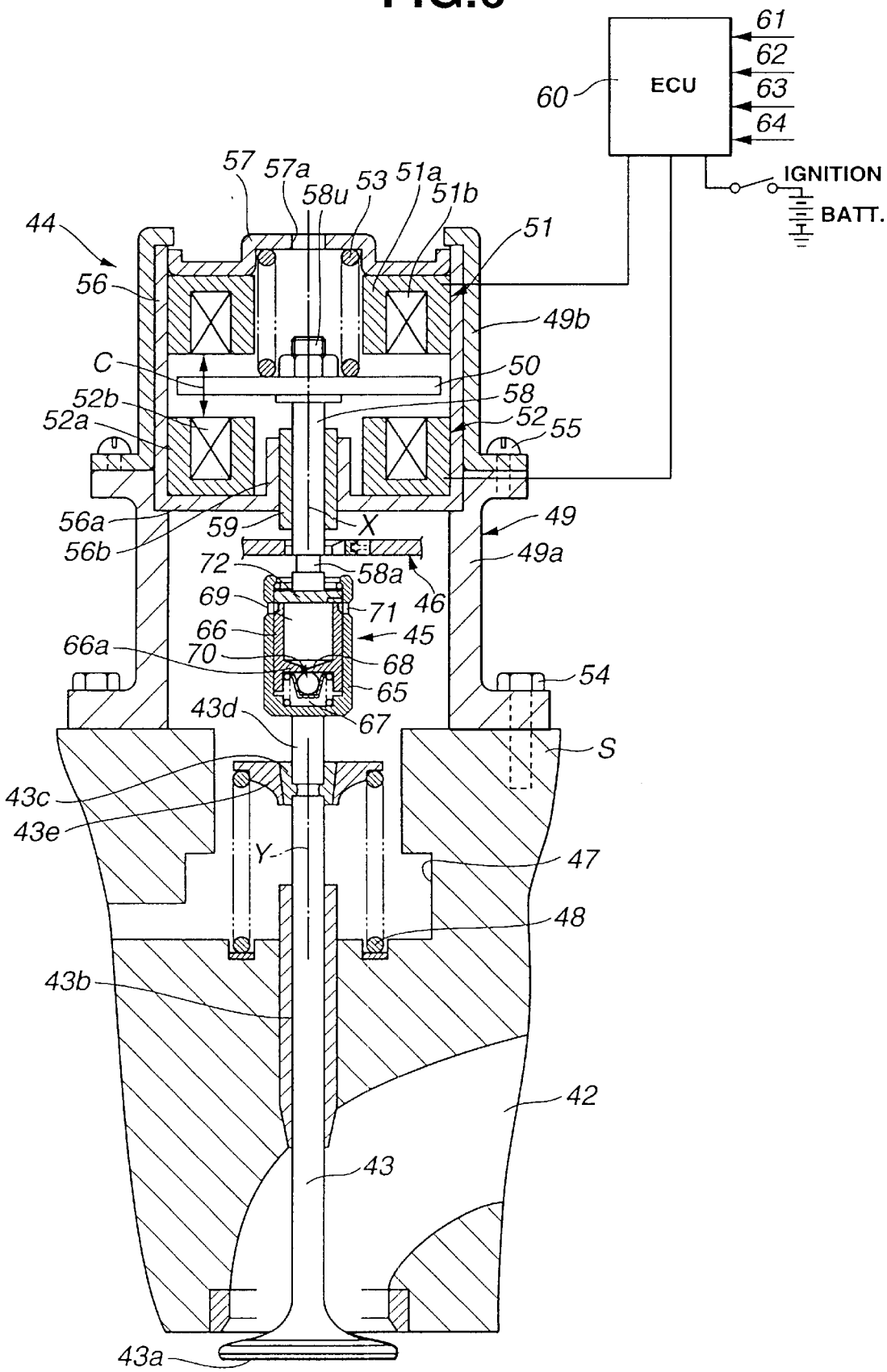
FIG. 6 is a longitudinal cross-sectional view illustrating a zero lash adjuster equipped valve operating device of the second embodiment that the lash adjuster is installed in an electromagnetically-operated valve.

Referring now to FIG. 6, there is shown the zero lash adjuster equipped valve operating device of the second embodiment. The zero lash adjuster equipped valve operating device of the second embodiment of FIG. 6 is different from that of the first embodiment of FIGS. 1 and 2, in that the zero lash adjuster equipped variable valve operating device of the second embodiment is applied to an electromagnetically-operated intake valve 43. The valve operating device of the second embodiment includes electromagnetically-operated intake valve 43, an electromagnetic drive mechanism 44, a hydraulic zero lash adjuster (a valve-lash adjusting means) 45, and a restriction mechanism (restriction means) 46. Electromagnetically-operated intake valve 43 functions to open and close the opening end of an intake-valve port 42 formed in cylinder head S. Electromagnetic drive mechanism 44 is provided to electromagnetically drive intake valve 43. Hydraulic zero lash adjuster 45 is disposed between intake valve 43 and electromagnetic drive mechanism 44 to provide zero valve lash. Intake valve 43 is constructed by a valve head (or a valve fillet portion) 43*a* and a valve stem 43*b*. Valve fillet portion 43*a* opens and closes the opening end of intake port 42 facing the combustion chamber by lifting off the annular valve seat against which the valve face comes to rest and by seating or re-seating on the valve seat. Valve stem 43*b* is formed integral with the upper central portion of valve fillet portion 43*a* and slidably fitted into the bore formed in cylinder head S by means of a valve guide (not numbered). A valve spring (biasing means or biasing device) 48 is disposed between a valve spring retainer 43*e* and the bottom face of a valve retaining groove or hole 47, such that intake valve 43 is normally biased in its valve-closing direction. Valve spring retainer 43*e* is located on the outer periphery of a valve-spring retainer lock or a conical-type valve collet or a conical-type valve cotter 43*c* fixedly connected to a valve stem end 43*d* of valve stem 43*b*. Valve retaining hole 47 is formed in cylinder head S. Valve stem end 43*d* of intake valve 43 is conditioned in abutted-contact with the lower closed end face of a cylindrical body 65 (described later) of hydraulic zero lash adjuster 45. Electromagnetic drive mechanism 44 is comprised of a casing 49 mounted on cylinder head S, a disk-shaped armature 50, an upper electromagnet 51 functioning to close the intake valve, a lower electromagnet 52 functioning to open the intake valve, and an upper spring 53 whose spring bias acts in the valve-opening direction. Disk-shaped armature 50 is accommodated in casing 49 in a manner so as to be movable between the lower face of upper electromagnet 51 and the upper face of lower electromagnet 52 in the axial direction of the intake-valve stem. Upper spring 53 is disposed between the inner peripheral wall surface of a lid portion 57 (described later) of casing 49 and the upper face of armature 50 to permanently bias the armature in the valve-opening direction. As clearly shown in FIG. 6, casing 49 is constructed by two parts, namely a substantially cylindrical metal body 49*a* and a substantially cylindrical non-magnetic cover 49*b*. Metal body 49*a* is fixedly connected or bolted to cylinder head S by means of four bolts 54. Non-magnetic cover 49*b* is fixedly connected to the upper flat portion of metal body 49*a* by means of screws 55. Additionally, a cylindrical non-magnetic holder 56 is fitted into the inner peripheral wall surface of non-magnetic cover 49*b*. A radially-stepped, hat-shaped non-magnetic lid portion 57 is fixedly connected to the upper opening end of cylindrical non-magnetic holder 56. Upper electromagnet 51 is attached to non-magnetic lid portion 57. Cylindrical non-magnetic holder 56 is integrally formed at its lower end with a bottom wall portion 56*a* onto which lower electromagnet 52 is attached. Bottom wall portion 56*a* is also formed integral with an axially extending central cylindrical wall portion 56*b*. An air bleeder hole 57*a* is bored in the central portion of non-magnetic lid portion 57. Disk-shaped armature 50 is disposed between upper and lower electromagnets 51 and 52 such that upper and lower faces of armature 50 are opposite to the lower face of upper electromagnet (valve-closing electromagnet) 51 and the upper face of lower electromagnet (valve-opening electromagnet) 52. The central portion of armature 50 is fixedly connected to the upper end 58*u* of a guide rod (or an armature shaft) 58 by way of a nut. The upper end portion of hydraulic zero lash adjuster 45 is linked to the lower end of guide rod 58. A cylindrical guide portion 59 is fixedly fitted into the inner peripheral wall surface of central cylindrical wall portion 56*b*. Guide rod 58 is axially slidably fitted into cylindrical guide portion 59. The axis X of guide rod 58 is concentric to the axis Y of intake-valve stem 43*b*. As seen in FIG. 6, valve-closing electromagnet 51 is comprised of a fixed core 51*a* and an electromagnetic coil 51*b*, whereas valve-opening electromagnet 52 is comprised of a fixed core 52*a* and an electromagnetic coil 52*b*. Fixed core 51*a* having a substantially U-shape in lateral cross section and fixed core 52*a* having the same substantially U-shape in lateral cross section are arranged such that the opening end (the lower end) of fixed core 51*a* is opposite to the opening end (the upper end) of fixed core 52*a*, sandwiching armature 50 therebetween with a small core-to-armature clearance. Electromagnetic coil 51*b* is wound inside of the substantially U-shaped recess of fixed core 51*a*, whereas electromagnetic coil 52*b* is wound inside of the substantially U-shaped recess of fixed core 52*a*. An attraction force attracting armature 50 upwards or an attraction force attracting armature 50 downwards is properly applied to or released from armature 50 in response to an energizing (exciting) signal or a de-energizing (non-exiting) signal from an electronic control unit (ECU) 60 (described later) to each of electromagnetic coils 51*b* and 52*b*. The spring bias of upper spring (valve-opening spring) 53 is balanced to the spring bias of valve spring (valve-closing spring) 48 when each of electromagnets 51 and 52 is de-energized, so that armature 50 is kept substantially in its balanced, neutral position corresponding to a substantially midpoint between two fixed electromagnets 51 and 52. With the armature 50 kept substantially in the balanced, neutral position, intake valve 43 is held substantially in a middle position (i.e., a half-open position) between the intake valve closed position and the intake valve full-open position. The structure of ECU 60 of the device of the second embodiment is similar to that of ECU 35 of the device of the first embodiment. The input/output interface (I/O) of ECU 60 receives input information from various engine/vehicle sensors, namely a crank angle sensor 61, an engine speed sensor 62, a temperature sensor 63 that detects a temperature of valve-closing electromagnet 51, and an airflow meter 64 that detects engine load. Within ECU 60, the central processing unit (CPU) allows the access by the I/O interface of input informational data signals from the previously-discussed engine/vehicle sensors 61, 62, 63 and 64 to estimate engine operating conditions based on the sensor signals. The CPU of ECU 60 is responsible for carrying the engine control program (containing the energization-deenergization control for each of valve-closing electromagnet 51 and valve-opening electromagnet 52) stored in memories and is capable of performing necessary arithmetic and logic operations. Computational results (arithmetic calculation results), that is, a calculated output signal (an exciting current or a non-exciting current) is repeatedly relayed via the output interface circuitry of ECU 60 to an output stage, namely electromagnetic coils 51*b* and 52*b*, to provide proper intake-valve opening and closing operations. As can be seen from the longitudinal cross section of FIG. 6, hydraulic zero lash adjuster 45 of the second embodiment is similar to hydraulic zero lash adjuster 2 of the first embodiment in construction. Hydraulic zero lash adjuster 45 is comprised of a substantially cylindrical body 65, and a plunger 66 provided inside of cylindrical body 65 such that the outer peripheral wall of plunger 66 is axially slidably fitted into the inner peripheral wall of cylindrical body 65. Cylindrical body 65 and plunger 66 are concentrically arranged with respect to the axis of intake-valve stem 43*b*. Plunger 66 has a partition wall portion 66*a* integrally formed therein. Partition wall portion 66*a* has a central communication hole 68. A high-pressure chamber 67 is defined between one side wall (the lower side wall in FIG. 6) of partition wall portion 66*a* and cylindrical body 65. A reservoir chamber 69 is defined in plunger 66 and above the other side wall (the upper side wall in FIG. 6) of partition wall portion 66*a* of plunger 66. Reservoir chamber 69 is communicated with high-pressure chamber 67 via central communication hole 68. A check valve 70 is disposed in high-pressure chamber 67 to permit only the working-fluid flow from reservoir chamber 69 to high-pressure chamber 67. As shown in FIG. 6, a working-fluid supply hole 71 is bored in the upper peripheral wall of plunger 66 for hydraulic pressure supply (working-fluid pressure) to reservoir chamber 69. The stem end of intake-valve stem 43*b* is in contact with the closed end of cylindrical body 65. A disk-shaped cap 72 is attached to the upper opening end portion of plunger 66, so that the upper opening end portion of plunger 66 is hermetically closed by cap 72 in a fluid-tight fashion. The upper surface of cap 72 is conditioned in contact with the lower end of guide rod 58.

Figure 7A:
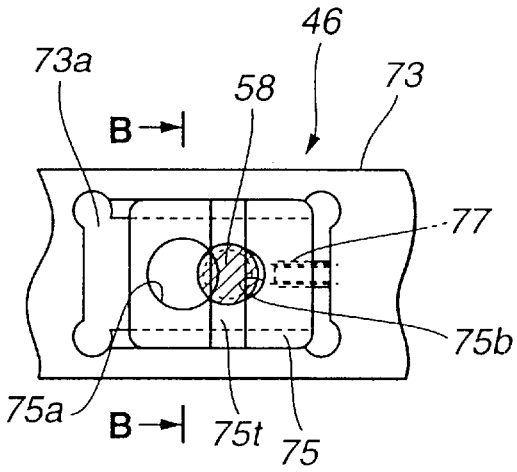
FIG. 7A is a plan view illustrating the essential part of a restriction mechanism that restricts the compressive force acting on the zero lash adjuster of the second embodiment.
Figure 7C:
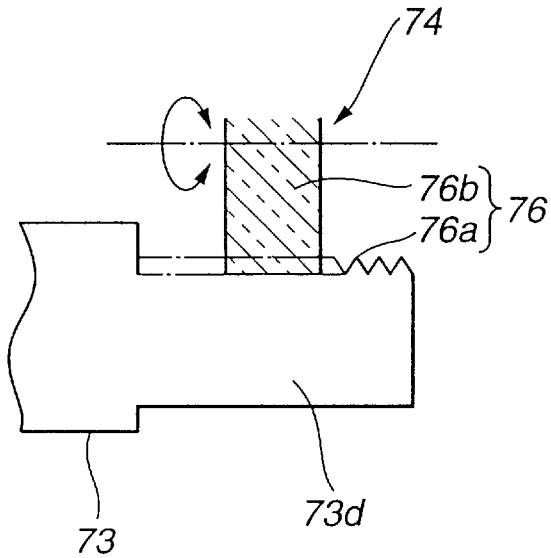
FIG. 7C is aside view illustrating apart of a driving portion of the restriction mechanism of FIG. 7A.
Figure 7B:
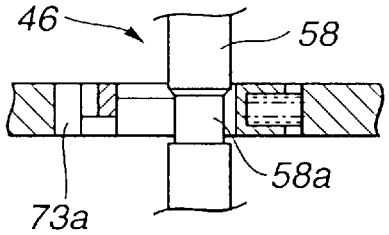
FIG. 7B is a cross section of the restriction mechanism of FIG. 7A.
Figure 8:
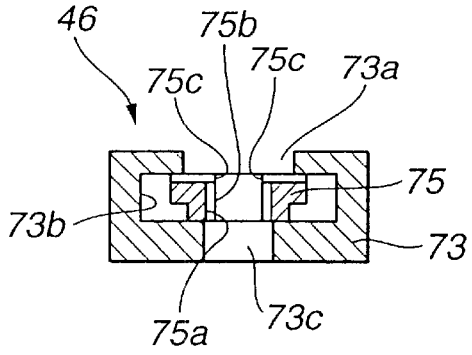
FIG. 8 is a lateral cross section, taken along the line B—B of FIG. 7A.

In the hydraulic zero lash adjuster equipped valve operating device of the second embodiment shown in FIG. 6, restriction mechanism (restriction means) 46 is comprised of an annular engaging groove 58*a* (see FIG. 7B), an elongated plate-shaped restriction member 73 (see FIGS. 7A–7C and 8), a restriction-member actuator 74 (see FIG. 7C), a rectangular slider 75 (see FIGS. 7A and 8), and a car battery (see FIG. 6). Annular engaging groove 58*a* is formed at the lower end portion of guide rod 58. Restriction member 73 is loosely fitted to the lower end portion of guide rod in such a manner as to be slidable in a direction normal to the axis of guide rod 58. Restriction member 73 is elongated in the direction normal to the axis of guide rod 58. Restriction-member actuator 74 is mechanically linked to restriction member 73 such that restriction member 73 is slid in the direction (the longitudinal direction of restriction member 73) normal to the axis of guide rod 58 by means of actuator 74. Rectangular slider 75 is slidably attached to a portion of restriction member 73 substantially conforming to guide rod 58. Electric power is supplied from the car battery via the output interface of ECU 60 to restriction-member actuator 74. As best seen in FIGS. 7A and 8, restriction member 73 is formed with a substantially rectangular hole 73*a* elongated in the longitudinal direction of restriction member 73, and a retention groove 73*b* that slidably holds rectangular slider 75 in the longitudinal direction of restriction member 73. An insertion hole 73*c* is formed in the bottom portion of restriction member 73. The lower end portion of guide rod 58 passes through both of rectangular hole 73*a* and insertion hole 73*c*, and is brought into contact with the upper face of cap 72 of hydraulic zero lash adjuster 45. As clearly shown in FIG. 7C, restriction-member actuator 74 is comprised of a gear mechanism 76 and an electric motor (not shown). Gear mechanism 76 includes a worm gear 76*a* formed on the upper surface of one end 73*d* (the right-hand end in FIG. 7C) of restriction member 73 and a motor-driven worm 76*b* in meshed engagement with worm gear 76*a*. A reversible motor is used as the motor having a driving connection with worm 76*b*. The rotation direction and the degree of rotary motion of worm 76*b* (that is, sliding motion of restriction member 73) are controlled in response to a control signal generated from ECU 60 to the motor. Rectangular slider 75 is designed and dimensioned so that slider 75 is slidable in rectangular hole 73*a* while both sides of slider 75 is held or supported by respective retention grooves 73*b*, 73*b* of restriction member 73. A relatively large-diameter sliding-motion permissible hole (simply, a sliding hole) 75*a* is formed in the left-hand half of slider 75, whereas a relatively small-diameter slotted hole 75*b* is formed in the substantially central portion of slider 75. Guide rod 58 is loosely fitted into sliding hole 75*a* in such a manner as to permit axial sliding motion of guide rod 58 in sliding hole 75*a*. Slotted hole 75*b* is formed in slider 75 continuously with sliding hole 75*a*, such that slotted hole 75*b* extends from the rightmost end of sliding hole 75*a* in the longitudinal direction of restriction member 73. Two opposing inside edges 75*c*, 75*c* of slotted hole 75*b*, being opposite to each other in the direction perpendicular to both the axis of guide rod 58 and the longitudinal direction of restriction member 73, are engageable with engaging groove 58*a* of guide rod 58 when slider 75 moves leftwards with respect to the axis of guide rod 58. As best seen in FIG. 7A, an intermediate portion of slider 75 conforming to slotted hole 75*b* is formed as a tapered surface 75*t* that is down-sloped toward sliding hole 75*a*. A spring 77 is attached to the right-hand end of slider 75 near slotted hole 75*b* and thus slider is normally spring-loaded, so that sliding hole 75*a* matches guide rod 58 by means of the spring bias of spring 77.

With the previously-discussed arrangement, the hydraulic zero lash adjuster equipped valve operating device of the second embodiment operates as follows.

Figure 10:
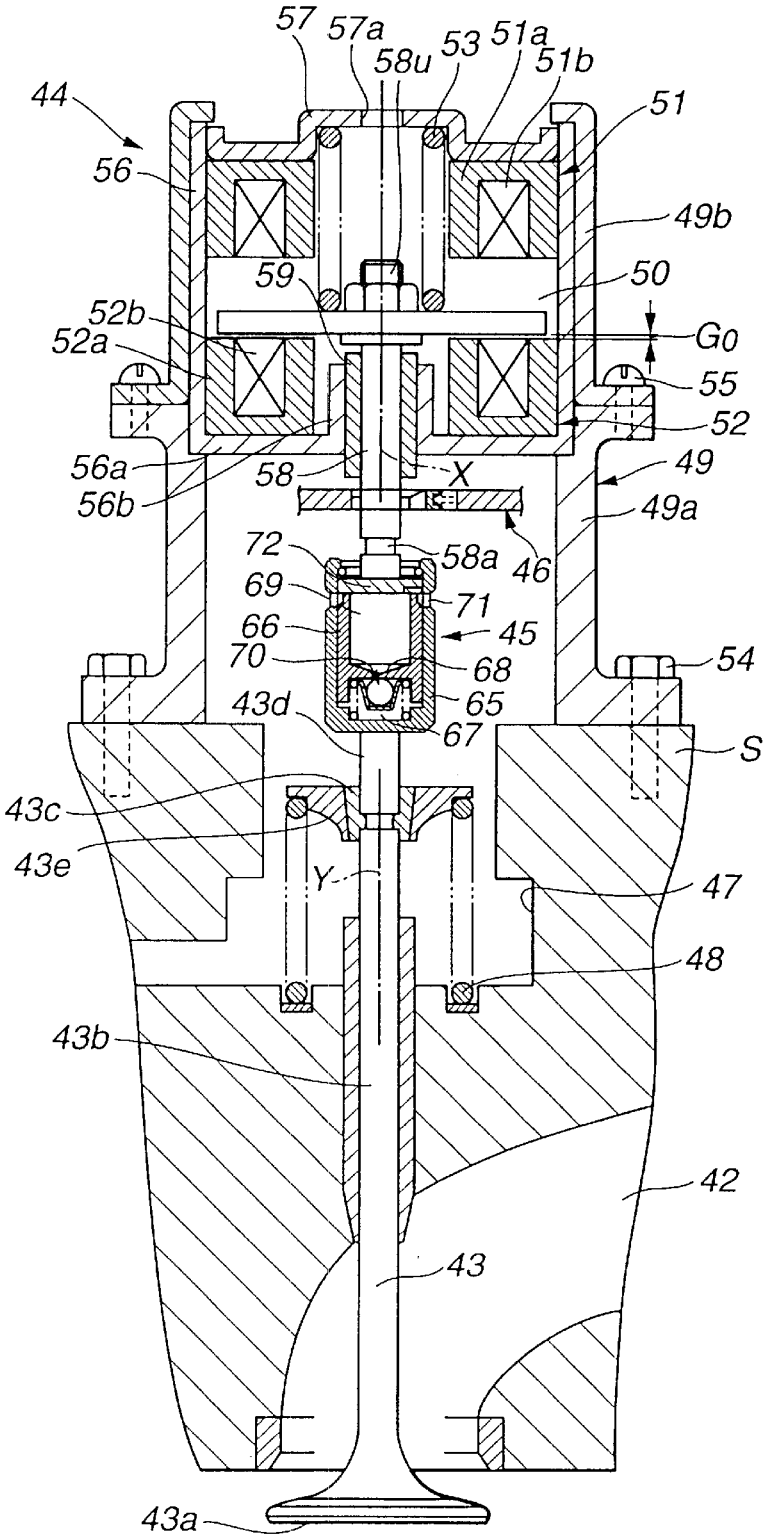
FIG. 10 is a longitudinal cross-sectional view illustrating the operation of the zero lash adjuster equipped valve operating device of the second embodiment, when opening the intake valve.

When the engine is in the stopped state, owing to OFF signals from ECU 60 to electromagnetic coil 51*b* of valve-closing electromagnet 51 and electromagnetic coil 52*b* of valve-opening electromagnet 52, coils 51*b* and 52*b* become de-energized. Thus, as shown in FIG. 6, disk-shaped armature 50 is kept substantially in the balanced, neutral position substantially corresponding to the midpoint of a clearance C defined between two fixed electromagnets 51 and 52. Therefore, intake valve 43 is also held substantially in the middle position (i.e., the half-open position slightly spaced apart from the valve seat) between the intake valve closed position and the intake valve full-open position. On the contrary, when the engine is started and intake valve 43 is opened, an exciting current is output from ECU 60 to electromagnetic coil 52*b* of valve-opening electromagnet 52, and whereby armature 50 is attracted by valve-opening electromagnet 52 and moves downwards by means of the spring bias of valve-opening spring 53 and the attraction force until a clearance defined between the lower face of armature 50 and the upper face of lower electromagnet 52 reaches a very small clearance Go (viewing FIG. 10). At this time, hydraulic zero lash adjuster 45, linked to the lower end of guide rod 58, moves downwards and thus the closed end of cylindrical body 65 downwardly pushes intake-valve stem end 43*d*. As a result, intake valve 43 moves down against the spring bias of valve-closing spring 48, and thus the down-stroke of intake valve 43 takes place. In contrast, when intake valve 43 is closed during operation of the engine, an exciting current applied from ECU 60 to electromagnetic coil 52*b* of valve-opening electromagnet 52 is blocked, while an exciting current is applied from ECU 60 to electromagnetic coil 51*b* of valve-closing electromagnet 51. At this time, armature 50 functions to upwardly move hydraulic zero lash adjuster 45 against the spring bias of valve-opening spring 53 by virtue of a resultant force of the attraction force created by valve-closing electromagnet 51 and spring bias of valve-closing spring 48. Thus, intake valve 43 moves upwards by the spring bias of valve-closing spring 48 and as a result valve fillet portion 43*a* seats on the valve seat, and intake valve 43 becomes closed. When intake valve 43 moves up to the vicinity of the intake-valve closed position or when intake valve 43 moves down to the vicinity of the intake-valve full-open position, hydraulic zero lash adjuster 45 provides a cushioning effect that permits this arrangement without undue shock loading, by virtue of the internal pressure (the working-fluid pressure) in hydraulic zero lash adjuster 45, and to provide zero valve lash between intake-valve stem end 43*d* and the lower end of guide rod 58. This prevents hammering noise (or tappet noise) from occurring between the intake-valve stem end and the guide rod. On the other hand, restriction mechanism (restriction means) 46 operates as follows.

Figure 9A:
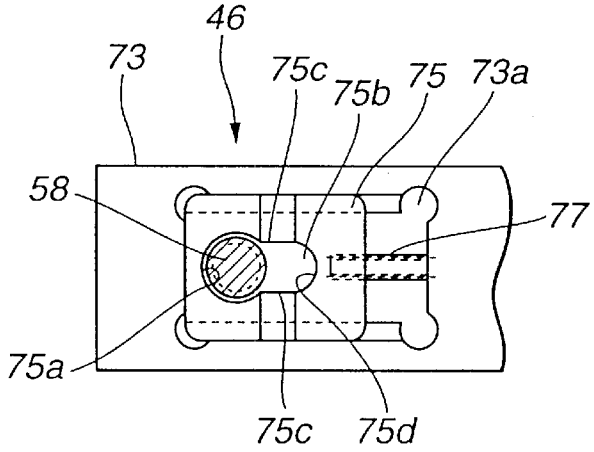
FIG. 9A is a plan view explaining the operation of the restriction mechanism.
Figure 9B:
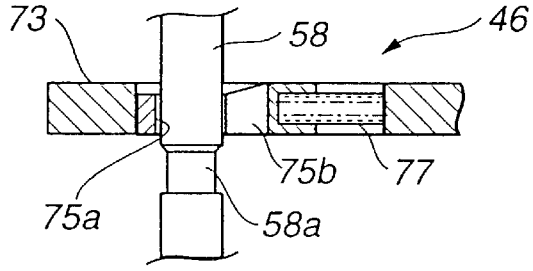
FIG. 9B is a cross-sectional view explaining the operation of the restriction mechanism.

During operation of the engine, there is no control current from ECU 60 to the electric motor of restriction-member actuator 74. In the de-energized state of actuator 74, as shown in FIGS. 9A and 9B, restriction member 73 is maintained at its rightmost position. Additionally, slider 75 is maintained at its leftmost position within rectangular hole 73*a* by the spring bias of spring 77. At this time, engaging groove 58*a* of guide rod 58 shifts to the position of sliding hole 75*a* of slider 75, in a manner so as to permit axial sliding motion of guide rod 58 in sliding hole 75*a*.

Figure 11:
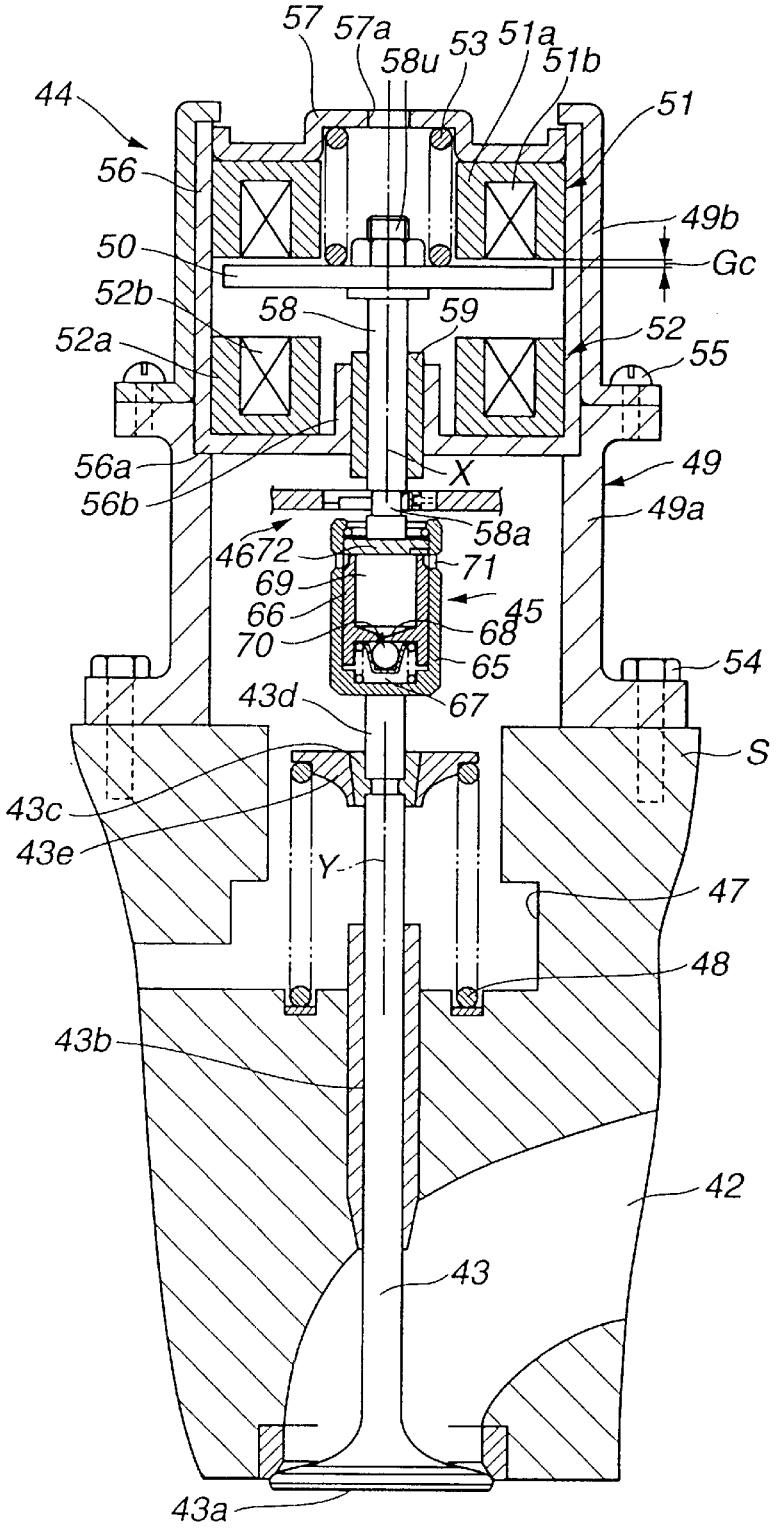
FIG. 11 is a longitudinal cross-sectional view illustrating the operation of the zero lash adjuster equipped valve operating device of the second embodiment, when closing the intake valve.

In contrast to the above, just after the engine has been stopped, first of all, electric power of the car battery is output from ECU 60 to valve-closing electromagnet 51, and as a result armature 50 lifts up or moves upwards against the spring bias of valve-opening spring 53 until a clearance defined between the upper face of armature 50 and the lower face of upper electromagnet 51 reaches a very small clearance Gc (viewing FIG. 11). Thus, intake valve 43 is maintained in the valve-closed state, and additionally engaging groove 58*a* of guide rod 58 becomes leveled up to the position of sliding hole 75*a* of slider 75 (see FIG. 11). Secondly, a control current is output from ECU 60 to the electric motor of restriction-member actuator 74 to cause rotary motion of worm gear 76 in a normal-rotational direction. As a result of this, restriction member 73 slides leftwards (see FIGS. 7A and 7B) from the rightmost position shown in FIGS. 9A and 9B, and thus slider 75 also moves leftwards together with restriction member 73. Therefore, engaging groove 58*a* of guide rod 58 shifts from sliding hole 75*a* of slider 75 to slotted hole 75*b* of slider 75 such that the opposing inside edges 75*c*, 75*c* of slotted hole 75*b* are brought into engagement with engaging groove 58*a* of guide rod 58. Slider 75 is pushed against the spring bias of spring 77 via the inside edged portion 75*d* of slotted hole 75*b* and recovered to its engagement position with engaging groove 58*a*. As a consequence, complete engagement between engaging groove 58*a* and the inside edged portion of slotted hole 75*b* is achieved. Such complete engagement reliably restricts or prevents or locks axial movement (in particular, axially downward movement) of guide rod 58 in the engine stopped state. Therefore, it is possible to avoid the pressure (the compressive force) from being applied from guide rod 58 to plunger 66 of hydraulic zero lash adjuster 45 owing to axially downward movement of guide rod 58. As a result, it is possible to reliably prevent the occurrence of working-fluid leakage within hydraulic zero lash adjuster 45, even in the engine stopped state. As discussed above, the hydraulic zero lash adjuster equipped valve operating device of the second embodiment can provide the same effects as that of the first embodiment. When the engine operating mode is switched from a stopped state to a restarting state, first of all, ECU 60 outputs a control current to the motor of restriction-member actuator 74 to rotate the motor in a reverse-rotational direction immediately when the ignition switch is switched from a turned-off state to a turned-on state for restarting the engine. During operation of the engine, except during the engine starting or restarting and during the engine stopped state, there is no control current output from ECU 60 to the motor of restriction-member actuator 74. Owing to the reverse rotation of the motor of restriction-member actuator 74, restriction member 73 slides rightwards from the position shown in FIGS. 7A and 7B to the position shown in FIGS. 9A and 9B. As a result, engaging groove 58*a* of guide rod 58 becomes disengaged or unlocked from slotted hole 75*b* of slider 75, and guide rod 58 is located within sliding hole 75*a* of slider 75. Thus, guide rod 58 is free to axially move. Thereafter, the engine restarting state has been completed and there is no risk that the normal operation of armature 50 is affected by the delay in disengaging engaging groove 58*a* from slotted hole 75*b* during engine restarting.

As set forth above, according to the hydraulic zero lash adjuster equipped valve operating device of the second embodiment shown in FIGS. 6–11, transverse sliding motion of restriction member 73 is executed by way of normal rotation of the motor (i) when engaging groove 58*a* has to be engaged with slotted hole 75*b* in the engine stopped state, and executed by way of reverse rotation of the motor (ii) when engaging groove 58*a* has to be disengaged from slotted hole 75*b* in the engine restarting state. Therefore, it is possible to reduce or suppress the electric power consumption to a minimum.

In the second embodiment, restriction member 73 is electrically operated leftwards or rightwards. In lieu thereof, restriction member 73 may be mechanically or hydraulically operated. In the shown embodiments, although the hydraulic zero lash adjuster equipped valve operating device is applied to an intake-port valve of engine valves of an internal combustion engine, instead thereof the hydraulic zero lash adjuster equipped valve operating device may be applied to an exhaust-port valve.

The hydraulic zero lash adjuster equipped valve operating device of the second embodiment is exemplified in an intake valve operating device with electromagnetic drive mechanism 44 for electromagnetically-operated intake valve 43. In this case, there is an increased tendency for a valve-opening velocity or a valve-closing velocity of the engine valve to become faster during the engine starting or restarting period. Thus, hammering noise tends to occur. The hydraulic zero lash adjuster employed in the device of the second embodiment can provide a better cushioning effect (a better noise-reduction effect) even in case of the use of electromagnetic drive mechanism 44 for electromagnetically-operated intake valve 43.

As will be appreciated from the above, according to the devices of the first and second embodiments, during the engine stopped state there is no pressure applied from the engine valve stem end and a valve drive mechanism (variable valve lift characteristic mechanism 1 or electromagnetic drive mechanism 44) to the hydraulic zero lash adjuster. Thus, it is possible to effectively prevent leakage of working fluid from the hydraulic zero lash adjuster during the engine stopped state, thereby reducing a possibility of undesired contraction of the hydraulic zero lash adjuster during the stopped period. Therefore, the hydraulic zero lash adjuster employed in the devices of the shown embodiments provide a better cushioning effect even when restarting the engine, thus effectively reducing or attenuating hammering noise of the engine valve during engine restarting as well as during operation of the engine. Also, it is possible to prevent air from being introduced into the reservoir chamber or the high-pressure chamber and undesirably blended with working fluid in these chambers, by eliminating undesired contraction of the hydraulic zero lash adjuster. As a consequence, it is possible to enhance the stability and reliability of opening and closing operations of the engine valve.

The entire contents of Japanese Patent Application No. P2001-369758 (filed Dec. 4, 2001) is incorporated herein by reference.

While the foregoing is a description of the preferred embodiments carried out the invention, it will be understood that the invention is not limited to the particular embodiments shown and described herein, but that various changes and modifications may be made without departing from the scope or spirit of this invention as defined by the following claims.

What is claimed is:

1. A valve operating device for an internal combustion engine with an engine valve that opens and closes either of an intake port and an exhaust port of the engine, comprising:

a biasing device that biases the engine valve in a valve-closing direction;

a valve drive mechanism that opens the engine valve against a biasing force of the biasing device;

a hydraulic zero lash adjuster disposed between the engine valve and the valve drive mechanism to adjust each of a clearance between the hydraulic zero lash adjuster and the engine valve and a clearance between the hydraulic zero lash adjuster and the valve drive mechanism to a zero clearance; and a restriction device that restricts a compressive force applied from each of the engine valve and the valve drive mechanism to the hydraulic zero lash adjuster when the engine is stopped.

2. The valve operating device as claimed in claim 1, wherein the valve drive mechanism comprises a variable valve lift characteristic mechanism that variably controls a valve lift of the engine valve.

3. The valve operating device as claimed in claim 2, wherein the valve drive mechanism variably controls the valve lift within a predetermined valve-lift range from a zero lift to a predetermined maximum lift.

4. The valve operating device as claimed in claim 3, wherein the valve drive mechanism sets the valve lift to the zero lift when the engine is stopped.

5. The valve operating device as claimed in claim 4, wherein the valve drive mechanism comprises an electrically-operated actuator that variably adjusts the valve lift, and the valve lift is adjusted to the zero lift by driving the electrically-operated actuator for a predetermined time period from a time when the engine has been stopped.

6. The valve operating device as claimed in claim 4, wherein the valve drive mechanism comprises a preloading device that creates a preload acting in a direction that the valve lift is adjusted to the zero lift, and the valve drive mechanism is operated against the preload created by the preloading device, when increasing the valve lift from the zero lift.

7. The valve operating device as claimed in claim 4, wherein the valve drive mechanism comprises an electrically-operated actuator that variably adjusts the valve lift, and the electrically-operated actuator is driven to increase the valve lift during starting of the engine and during restarting of the engine.

8. The valve operating device as claimed in claim 7, wherein the electrically-operated actuator begins to shift from an inoperative state to an operative state when an ignition switch is turned on, and recovers to a normal control mode based on engine operating conditions after the engine has been started.

9. The valve operating device as claimed in claim 2, wherein the valve drive mechanism comprises a cam that changes rotary motion of the cam to reciprocating motion of the engine valve, and a control shaft that variably controls an initial actuated position of the cam, and the valve lift is variably controlled by rotary motion of the control shaft.

10. The valve operating device as claimed in claim 1, wherein the valve drive mechanism comprises an electromagnetic drive mechanism, and the engine valve is driven directly by the electromagnetic drive mechanism.

11. The valve operating device as claimed in claim 1, wherein the hydraulic zero lash adjuster has a high-pressure chamber defined therein, and the hydraulic zero lash adjuster adjusts each of the clearance between the hydraulic zero lash adjuster and the engine valve and the clearance between the hydraulic zero lash adjuster and the valve drive mechanism to the zero clearance by supplying working fluid into the high-pressure chamber.

12. The valve operating device as claimed in claim 11, wherein the hydraulic zero lash adjuster has a reservoir chamber defined therein, and the hydraulic zero lash adjuster is constructed to flow the working fluid in the high-pressure chamber into the reservoir chamber.

13. The valve operating device as claimed in claim 12, wherein hydraulic pressure is supplied to the reservoir chamber.

14. The valve operating device as claimed in claim 13, wherein the hydraulic zero lash adjuster comprises a check valve that permits only a working-fluid flow from the reservoir chamber to the high-pressure chamber.

15. A valve operating device for an internal combustion engine with an engine valve that opens and closes either of an intake port and an exhaust port of the engine, comprising:

a biasing means for biasing the engine valve in a valve-closing direction;

a valve drive means for opening the engine valve against a biasing force of the biasing means;

a valve-lash adjusting means disposed between the engine valve and the valve drive means, for adjusting each of a clearance between the valve-lash adjusting means and the engine valve and a clearance between the valve-lash adjusting means and the valve drive means to a zero clearance; and a restriction means for restricting a compressive force applied from each of the engine valve and the valve drive means to the valve-lash adjusting means when the engine is stopped.

16. A valve operating device for an internal combustion engine with an engine valve that opens and closes either of an intake port and an exhaust port of the engine, comprising:

a biasing device that biases the engine valve in a valve-closing direction;

a valve drive mechanism that opens the engine valve against a biasing force of the biasing device;

a hydraulic zero lash adjuster disposed between the engine valve and the valve drive mechanism to adjust each of a clearance between the hydraulic zero lash adjuster and the engine valve and a clearance between the hydraulic zero lash adjuster and the valve drive mechanism to a zero clearance;

a restriction device that restricts a compressive force applied from each of the engine valve and the valve drive mechanism to the hydraulic zero lash adjuster when the engine is stopped;

a cam that changes rotary motion of the cam to reciprocating motion of the engine valve; and the restriction device returning the valve lift to the zero lift so that there is no application of the compressive force from each of the engine valve and the valve drive mechanism to the hydraulic zero lash adjuster when the engine is stopped.

17. A valve operating device for an internal combustion engine with an engine valve that opens and closes either of an intake port and an exhaust port of the engine, comprising:

a biasing device that biases the engine valve in a valve-closing direction;

a valve drive mechanism that opens the engine valve against a biasing force of the biasing device;

a hydraulic zero lash adjuster disposed between a stem end of the engine valve and the valve drive mechanism to adjust each of a clearance between the hydraulic zero lash adjuster and the engine valve and a clearance between the hydraulic zero lash adjuster and the valve drive mechanism to a zero clearance;

a restriction device that restricts a compressive force applied from each of the engine valve and the valve drive mechanism to the hydraulic zero lash adjuster when the engine is stopped;

the valve drive mechanism comprising:

(a) an armature mechanically linked to the engine valve;

(b) a valve-opening electromagnet creating an attraction force acting on the armature in a direction opening of the engine valve;

(c) a valve-closing electromagnet creating an attraction force acting on the armature in a direction closing of the engine valve;

(d) a biasing device creating a biasing force that holds the engine valve toward a neutral position by biasing the engine valve in the direction opening of the engine valve and in the direction closing of the engine valve; and (e) an armature shaft to which the hydraulic zero lash adjuster is linked; the armature shaft being concentric to a stem of the engine valve; and the restriction device comprising a restriction member that locks the armature shaft so that there is no application of the compressive force from each of the engine valve and the valve drive mechanism to the hydraulic zero lash adjuster when the engine is stopped.

18. The valve operating device as claimed in claim 17, wherein the restriction member is unlocked from the armature shaft when an ignition switch is turned on, so that the armature shaft is free to move in an axial direction of the stem of the engine valve.

19. A valve operating device for an internal combustion engine with an engine valve that opens and closes either of an intake port and an exhaust port of the engine, comprising:

a biasing device that biases the engine valve in a valve-closing direction;

a valve drive mechanism that opens the engine valve against a biasing force of the biasing device;

a hydraulic zero lash adjuster disposed between the engine valve and the valve drive mechanism to adjust each of a clearance between the hydraulic zero lash adjuster and the engine valve and a clearance between the hydraulic zero lash adjuster and the valve drive mechanism to a zero clearance;

a restriction device that restricts a compressive force applied from each of the engine valve and the valve drive mechanism to the hydraulic zero lash adjuster when the engine is stopped;

the valve drive mechanism comprising:

(a) a drive shaft rotating in synchronism with rotation of an engine crankshaft and having a drive cam integrally formed on an outer periphery of the drive shaft;

(b) a rockable cam opening the engine valve against a biasing force produced by the biasing device via the hydraulic zero lash adjuster;

(c) a rocker arm linked at one end to the drive cam and linked at the other end to the rockable cam; and (d) a control shaft having a control cam integrally formed on an outer periphery of the control shaft and oscillatingly supporting the rocker arm via the control cam;

the valve lift of the engine valve being variably controlled by adjusting an angular position of the control shaft based on engine operating conditions and by changing a center of oscillating motion of the rocker arm; and the valve lift being set to the zero lift by controlling the angular position of the control shaft by means of the restriction device.

20. A valve operating device for an internal combustion engine with an engine valve that opens and closes either of an intake port and an exhaust port of the engine, comprising:

a biasing device that biases the engine valve in a valve-closing direction;

a valve drive mechanism that opens the engine valve against a biasing force of the biasing device;

a hydraulic zero lash adjuster disposed between the engine valve and the valve drive mechanism to adjust each of a clearance between the hydraulic zero lash adjuster and the engine valve and a clearance between the hydraulic zero lash adjuster and the valve drive mechanism to a zero clearance;

a restriction device that restricts a compressive force applied from each of the engine valve and the valve drive mechanism to the hydraulic zero lash adjuster when the engine is stopped;

the valve drive mechanism comprising:

(a) an armature mechanically linked to the engine valve;

(b) a valve-opening electromagnet creating an attraction force acting on the armature in a direction opening of the engine valve;

(c) a valve-closing electromagnet creating an attraction force acting on the armature in a direction closing of the engine valve; and (d) a biasing device creating a biasing force that holds the engine valve toward a neutral position by biasing the engine valve in the direction opening of the engine valve and in the direction closing of the engine valve;

the hydraulic zero lash adjuster being disposed between the engine valve and the armature; and the restriction device comprising a restriction member that restricts movement of the armature toward the hydraulic zero lash adjuster and movement of the engine valve toward the hydraulic zero lash adjuster when the engine is stopped.

* * * * *